US006433741B2

(12) United States Patent
Tanizaki et al.

(10) Patent No.: US 6,433,741 B2
(45) **Date of Patent: *Aug. 13, 2002**

(54) DIRECTIONAL COUPLER, ANTENNA DEVICE, AND TRANSMITTING-RECEIVING DEVICE

(75) Inventors: Toru Tanizaki, Nagaokakyo; Ikuo Takakuwa, Suita, both of (JP); Tomohiro Nagai, Santa Rosa, CA (US); Kazutaka Higashi, Hirakata (JP)

(73) Assignee: Murata Manufacturing Co., Ltd. (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/346,601

(22) Filed: Jul. 2, 1999

(30) Foreign Application Priority Data

Jul. 7, 1998 (JP) ..... 10-191692
Jun. 7, 1999 (JP) ..... 11-160100

(51) Int. Cl.[7] ..... H01Q 1/32
(52) U.S. Cl. ..... 343/700 MS; 343/713; 333/161

(58) Field of Search ..... 343/700 MS, 713, 343/746, 748, 753, 762, 767, 771, 772; 333/161; 342/127

(56) References Cited

U.S. PATENT DOCUMENTS

| | | | | | |
|---|---|---|---|---|---|
| 3,121,848 | A | * | 2/1964 | Kruse, Jr. et al. | 333/10 |
| 4,288,760 | A | * | 9/1981 | Beyer et al. | 333/116 |
| 5,495,252 | A | * | 2/1996 | Adler | 342/127 |
| 6,016,092 | A | * | 1/2000 | Qiu et al. | 333/262 |
| 6,034,646 | A | * | 3/2000 | Heddebaut et al. | 343/771 |

* cited by examiner

*Primary Examiner*—Don Wong
*Assistant Examiner*—Shih-Chao Chen
(74) *Attorney, Agent, or Firm*—Ostrolenk, Faber, Gerb & Soffen, LLP

(57) ABSTRACT

A directional coupler including a first transmission line and a second transmission line adjacent to the first transmission line, the relative positions of the first transmission line and the second transmission line being changeable, an antenna element connected to a part of the directional coupler, and a driving mechanism for driving the directional coupler and the antenna element.

26 Claims, 14 Drawing Sheets

DIRECTIONAL COUPLER, ANTENNA DEVICE, AND TRANSMITTING-RECEIVING DEVICE

BACKGROUND OF THE INVENTION

1. Field of the Invention

The present invention relates to a directional coupler, an antenna device, and a transmitting-receiving device which are useful for a radar or the like with which the distance to a detection object or a relative velocity of the object is measured by transmission-reception of an electromagnetic wave in the millimetric wave band.

2. Description of the Related Art

In recent years, a so called "millimetric wave radar for car-mounting" has been developed, of which the purpose lies in that for example, the distance to a vehicle running ahead or after, and the relative velocity are measured from a running vehicle. In general, the transmitting-receiving device of the millimetric wave radar of the above type includes a module which comprises a millimetric wave oscillator, a circulator, a directional coupler, a mixer, an antenna, and so forth which are integrated together, and is attached to the front or rear of the vehicle.

For example, as shown in FIG. 25, at the vehicle on the right side in FIG. 25, the relative distance and relative velocity for the vehicle running ahead (shown on the left side in FIG. 25) are measured for example by transmission-reception of a millimetric wave according to the FM-CW system. FIG. 26 is a block diagram showing the overall configuration of the millimetric radar. In the case shown in FIG. 25, the transmitting-receiving device and the antenna shown in FIG. 26 are attached to the front of the vehicle, and ordinarily, the signal processing device is provided in an optional location. In the signal processing section of the signal processing device, the distance to and the relative velocity of the vehicle running ahead are extracted as numerical information by means of the transmitting-receiving device. In the control-alarm section, based on the velocity of the vehicle running after and the distance between both the vehicles, an alarm is provided when predetermined conditions are satisfied, or when the relative velocity of the vehicle running ahead exceeds a predetermined threshold.

In the conventional millimetric radar, the directivity of the antenna is fixed. Therefore, there occurs the case that the desired detection or measurement is not performed depending on conditions. More particularly, for example, if vehicles run in plural traffic lanes as shown in FIG. 27, it can not immediately be determined whether a vehicle running ahead is present in the lane where the vehicle is running after, based on only the received electromagnetic wave reflected from the vehicle running ahead. More particularly, as shown in FIG. 27, when an electromagnetic wave is sent from a vehicle Cm by use of a radiation beam designated by the reference character B2, a reflected wave from the vehicle Ca running ahead, together with a reflected wave from a vehicle Cb running in the opposite lane, is received. Accordingly, the determined relative velocity is unduly high, due to the reflected wave from the vehicle running in the opposite lane. As a result, inconveniently, an error alarm is given. Further, in an example shown in FIG. 28, even if an electromagnetic wave is sent forward from the vehicle Cm by use of the radiation beam designated by the reference character B1, the vehicle Ca running ahead in the lane where the vehicle is running after can not be detected. Further, as shown in FIG. 29, even if an electromagnetic wave is sent forward from the vehicle Cm by use of the radiation beam designated by B1, the vehicle Ca running ahead can not be detected.

Accordingly, it is proposed that the above-described problems can be solved by varying the direction of the radiation beam. For example, in the example of FIG. 27, by varying the radiation beam in the range of B1 to B3, operational processing, and comparing the measurement results obtained in the respective beam directions, the two detection objects running ahead and adjacent in the angular directions can be separately detected. Further, in the example shown in FIG. 28, by analyzing image information obtained by steering operation (steering by a steering wheel) or by means of a camera photographing the forward view with respect to the vehicle, the curve of the lane is judged, and the radiation beam is directed in the direction in dependence on the judgment, for example, the radiation beam is directed to the direction indicated by the reference character B2, and thereby, the vehicle Ca running ahead can be detected. Further, in an example shown by FIG. 29, by analyzing image information from a camera photographing the forward view, the hilly situation of the road is judged, and for example, the radiation beam is directed upwardly, namely, to the direction designated by the reference numeral B2, and thereby, the vehicle Ca running ahead can be detected.

However, referring to the method of changing the directivity of an electromagnetic wave in the conventional transmitting-receiving device operative in the microwave band or millimetric wave band, the whole of a casing containing the transmitting-receiving device including the antenna is rotated only with a motor or the like to change (tilt) the direction of the radiation beam. Accordingly, the whole of the device is large in size, and it is difficult to scan with the radiation beam while the direction of the radiation is changed at a high speed.

SUMMARY OF THE INVENTION

Accordingly, it is an object of the present invention to solve the above-described problems and to provide a directional coupler in which the relative positions of two transmission lines can be changed while the coupling of the two transmission lines is maintained, an antenna device, and a transmitting-receiving device which can be easily miniaturized due to the directional coupler and of which the directivity can be switched at a high speed.

In order to achieve the above object, according to a first aspect of the present invention, there is provided a directional coupler comprising a first microstrip line and a second microstrip line adjacent to the first microstrip line, the relative positions of the first microstrip line and the second microstrip line being changeable.

According to a second aspect of the present invention, there is provided a directional coupler comprising a first strip line, a second strip line adjacent to the first strip line, the relative positions of the first strip line and the second strip line being changeable.

According to a third aspect of the present invention, there is provided a directional coupler comprising a first slot line and a second slot line adjacent to the first slot line, the relative positions of the first slot line and the second slot line being changeable.

According to a fourth aspect of the present invention, there is provided a directional coupler comprising a first coplanar line and a second coplanar line adjacent to the first coplanar line, the relative positions of the first coplanar line and the second coplanar line being changeable.

According to a fifth aspect of the present invention, there is provided a directional coupler comprising a first wave guide and a second wave guide adjacent to the first wave guide, the relative positions of the first coplanar line and the second coplanar line being changeable.

According to a sixth aspect of the present invention, there is provided a directional coupler comprising a first suspended line and a second suspended line adjacent to the first suspended line, the relative positions of the first suspended line and the second suspended line being changeable.

Thus, in a variety of applications, available is the directional coupler of which the relative positions of the two transmission lines can be changed while the coupling of the two transmission lines is maintained.

According to the present invention. preferably, there is provided an antenna device including the directional coupler according to any one of the first through sixth aspects of the present invention, a primary radiator coupled or connected to a part of the directional coupler, and a driving mechanism for driving the directional coupler and the primary radiator.

Further, according to the present invention, there is provided a transmitting-receiving device including the antenna device according to the seventh aspect of the present invention, and a transmitting-receiving circuit connected to the antenna device.

Thus, an antenna device and an transmitting-receiving device of which the sizes are relatively small, and with which scanning with a radiation beam can be performed while the radiation beam direction can be changed at a high speed, are provided.

BRIEF DESCRIPTION OF THE DRAWING

FIG. 2, comprising

DESCRIPTION OF THE PREFERRED EMBODIMENT

Hereinafter, an antenna device according to an embodiment of the present invention will be described with reference to FIGS. 1 through 15.

Figure 1:
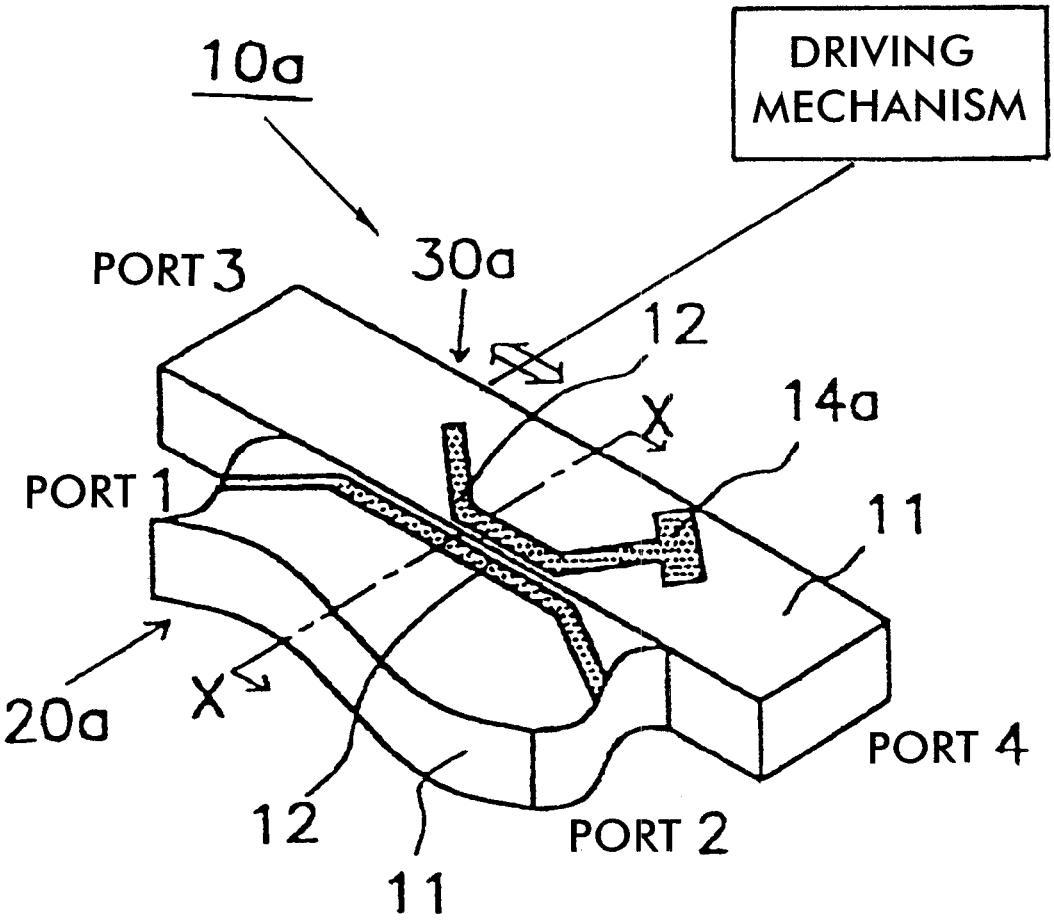
FIG. 1 is a perspective view of an antenna device according to a first embodiment of the present invention.

First, an antenna device according to a first embodiment of the present invention will be described with reference to FIG. 1. FIG. 1 is a perspective view of the antenna device of the first embodiment.

As shown in FIG. 1, an antenna device 10*a* of the instant embodiment comprises a directional coupler and a primary radiator. The directional coupler comprises a first transmission line 20*a* which comprises a microstrip line in which a line conductor 12 is formed on one of the main-faces of a dielectric substrate 11, and a ground conductor 13 (not shown in FIG. 1) is formed on the back side of the main-faces, and a second transmission line 30*a* which consists of a microstrip line formed in a similar manner. The primary radiator consists of a patch antenna 14*a* connected to the second transmission line 30*a*. The first transmission line 20*a* and the second transmission line 30*a* contain their portions which are linearly adjacent to each other. Through the portions, the two transmission lines are coupled to each other, and function as the directional coupler. More particularly, by designing properly, a half of a signal input through a port 2 can be output through a port 4, and the remaining half of the signal can be output through a port 1.

Figure 2A:
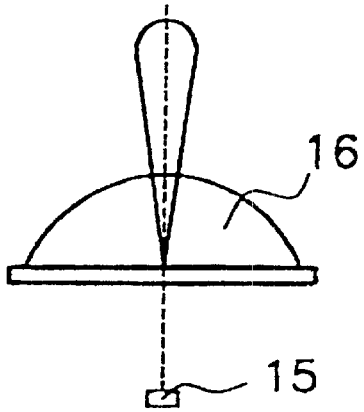
FIGS. 2A, 2B and 2C, is a schematic side view of a primary radiator and a dielectric lens antenna showing the relationship of the relation in position between them to the directivity of a radiation beam.
Figure 2B:
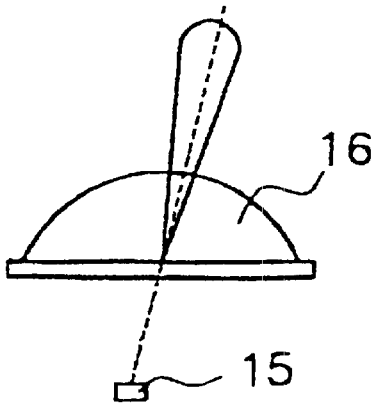
Figure 2C:
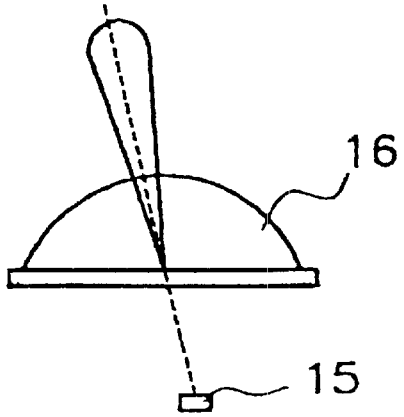

In the instant embodiment, the first transmission line 20*a* is fixed, while a driving mechanism 21 employing a voice coil motor, a pulse motor, or the like, is attached to the second transmission line 30*a*, and thereby, the second transmission line 30*a* can be shifted in the direction parallel to the line passing through a port 3 and the port 4 in FIG. 1. That is, the second transmission line 30*a* can be shifted while the linearly adjacent portions of the first transmission line 20*a* and the second transmission line 30*a* are maintained. Accordingly, while an electromagnetic wave is being radiated from the primary radiator connected to the second transmission line 30*a*, the position of the primary radiator can be changed. For example, as shown in the schematic side views of FIGS. 2A through 2C, if a dielectric lens 16 is arranged in the direction along which the electromagnetic wave of the primary radiator 15 is radiated, the directivity of the radiation beam can be changed as shown in FIGS. 2A through 2C by varying the position of the primary radiator 15 in the focal plane of the dielectric lens 16. That is, when the primary radiator 15 is disposed on the central axis of the dielectric lens 16, the electromagnetic wave is radiated in the central-axial direction. When the primary radiator 15 is arranged in departure from the central axis, the electromagnetic wave is radiated in a direction opposite to the departure.

Figure 3:
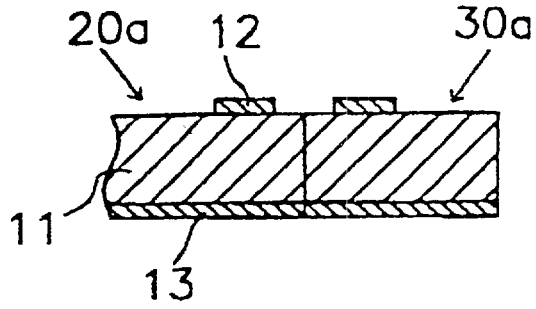
FIG. 3 is a cross sectional view taken along the line X—X of FIG. 1.
Figure 4:
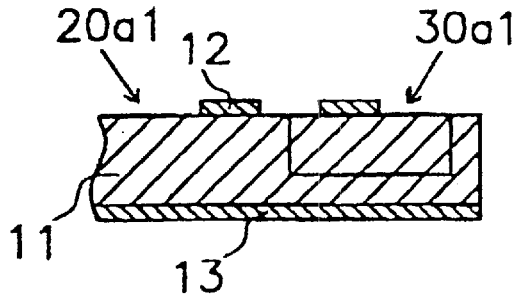
FIG. 4 is a cross sectional view of another form of the first embodiment.

As seen in the above-description, according to the present invention, the radiated bean can be caused to scan only by shifting the second transmission line 30*a* which is relatively light in weight. Further, since the microstrip lines are used as the first transmission line 20*a* and the second transmission line 30*a*, as in the instant embodiment, the antenna device can be connected to MMIC or the like, not using a line converter and so forth. This enhances the applicability of the antenna device. In the antenna device 10*a* of the instant embodiment, as shown in FIG. 3 which is a cross-sectional view of the antenna device 10*a* taken along the line X—X in FIG. 1, the first transmission line 20*a* and the second transmission line 30*a* are formed separately as an example. However, for example, as shown in the cross-sectional view of FIG. 4, the second transmission line 30*a*1 may be arranged in a concave portion provided for the first transmission line 20*a*1.

Figure 5:
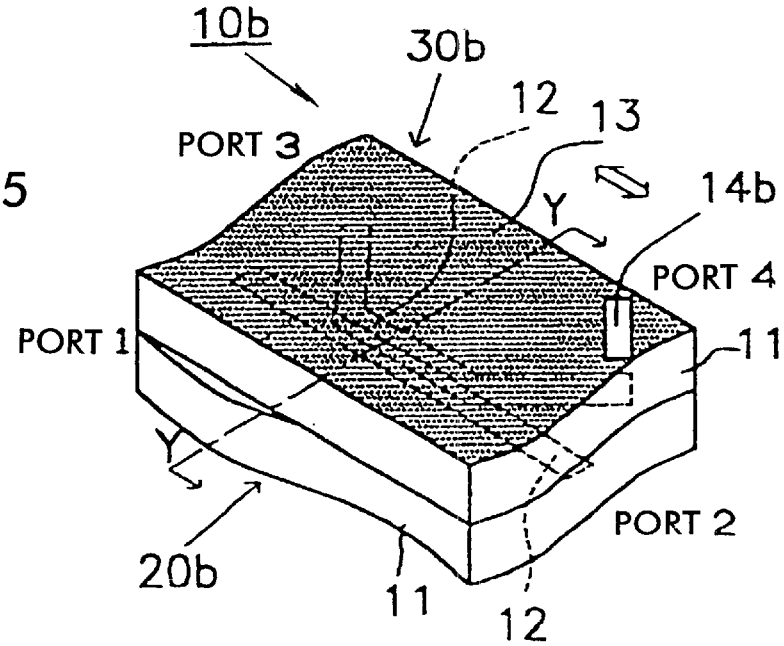
FIG. 5 is a perspective view of an antenna device according to a second embodiment of the present invention.

Hereinafter, an antenna device including the directional coupler according to a second embodiment of the present invention will be described with reference to FIG. 5. FIG. 5 is a perspective view of the antenna device of the instant embodiment. The basic function of the antenna device is the same as that of the first embodiment, and the detailed description of the antenna device of the instant embodiment will be omitted.

As seen in FIG. 5, the antenna device 10*b* of the instant embodiment comprises a directional coupler and a primary radiator. The directional coupler comprises a first transmission line 20*b* in which the ground conductor 13 is formed on one of the main-faces of the dielectric substrate 11, and the line conductor 12 is formed inside the dielectric substrate 11. The second transmission line 30*b* is formed in a similar manner. The primary radiator comprises a slot antenna 14*b* formed in the second transmission line 30*b*. The first transmission line 20*b* and the second transmission line 30*b* are so arranged as to be opposite to each other in the vertical direction, so that the first transmission line 20*b* and the second transmission line 30*b* function as a strip line. The first transmission line 20*b* and the second transmission line 30*b* contain the portions thereof which are linearly adjacent to each other. Through the portions, the two transmission lines are coupled to each other, and function as the directional coupler. The first transmission line 20*b* is fixed, while a driving mechanism (not shown in FIG. 5) employing a voice coil motor, a pulse motor, or the like is attached to the second transmission line 30*b*, and thereby, the second transmission line 30*b* can be shifted in the direction parallel to the line passing through the port 3 and the port 4 in FIG. 5.

Figure 6:
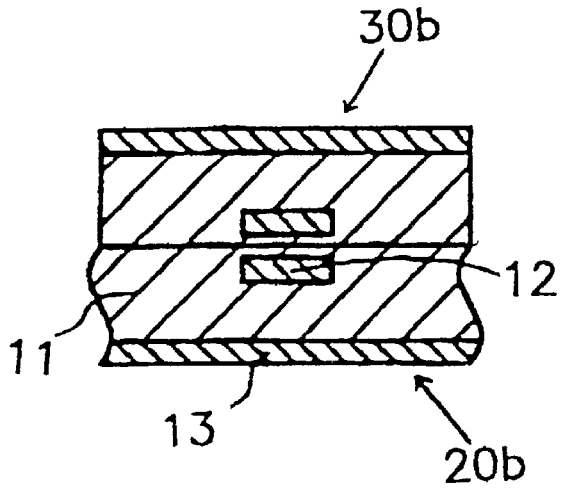
FIG. 6 is a cross sectional view taken along the line Y—Y of FIG. 5.
Figure 7:
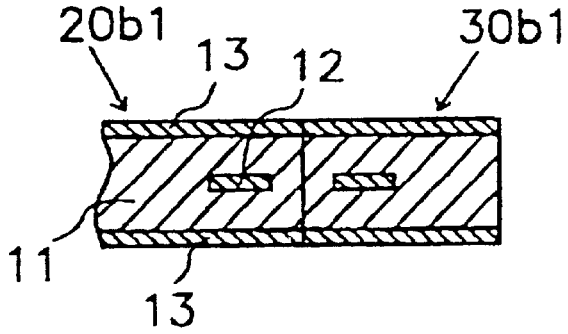
FIG. 7 is a cross sectional view of a further form of the second embodiment.
Figure 8:
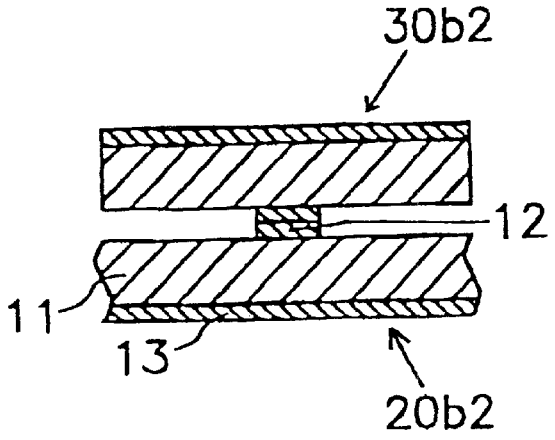
FIG. 8 is a cross sectional view of a still further form of the second embodiment.
Figure 9:
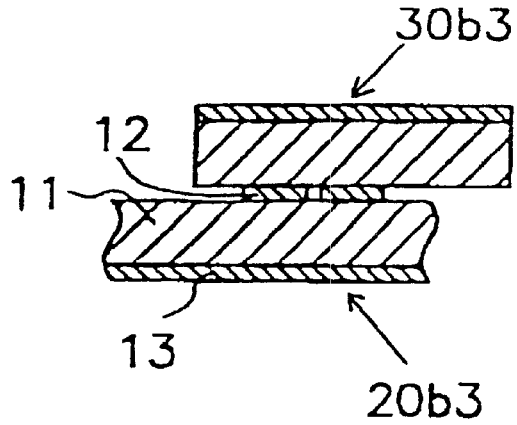
FIG. 9 is a cross sectional view of another form of the second embodiment.
Figure 10:
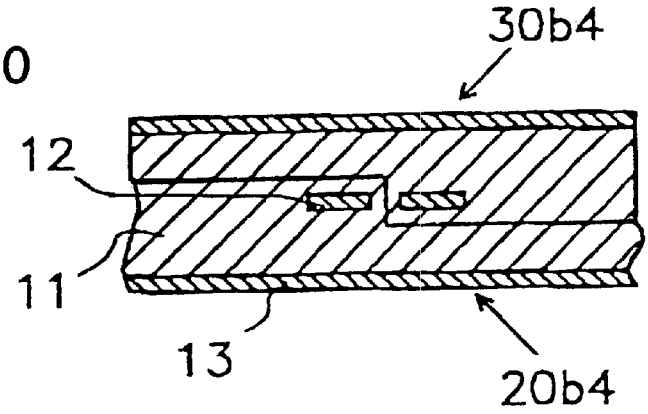
FIG. 10 is a cross sectional view of a further form of the second embodiment.
Figure 11:
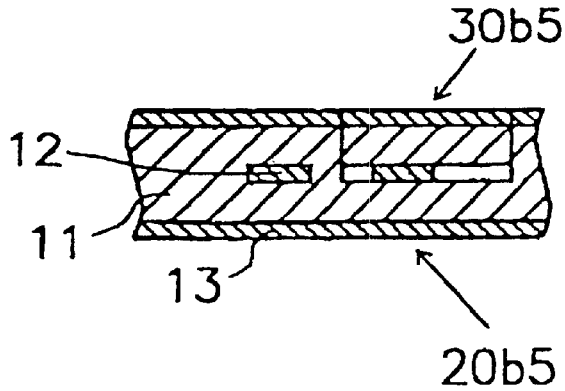
FIG. 11 is a cross sectional view of a still further form of the second embodiment.

In the antenna device 10*b* of the instant embodiment, as shown in FIG. 6 which is a cross sectional view of the antenna device taken along the line Y—Y in FIG. 5, the first transmission line 20*b* and the second transmission line 30*b* are so arranged as to be opposite to each other in the vertical direction as an example. However, as shown in the cross-sectional view of FIG. 7, the first transmission line 20*b*1 in which the ground conductor 13 is formed on the opposite sides of the dielectric substrate 11, and the line conductor 12 is formed inside the dielectric substrate, and the second transmission line 30*b*1 formed in a similar manner may be arranged side by side. Further, as shown in the cross-sectional view of FIG. 8, the first transmission line 20*b*2 in which the line conductor 12 is formed on one of the main-faces of the dielectric substrate 11, and the ground conductor 13 is formed on the other main-face, and the second transmission line 30*b*2 formed in a similar manner may be so arranged as to be opposite to each other in the vertical direction. Further, available are transmission lines 20*b*3 and 30*b*3 having the line conductors 12 of which the positions depart from each other as shown in the cross sectional view of FIG. 9. Moreover, as shown in the cross sectional view of FIG. 10, available are a first transmission line 20*b*4 having the ground conductor 13 formed on one of the main faces of the dielectric substrate 11 and the line conductor 12 formed inside the dielectric substrate 13, and a second transmission line 30*b*4 formed in a similar manner which are so arranged to be opposite to each other in the vertical direction, the position of the line conductors 12 departing from each other. Further, as shown in the cross sectional view of FIG. 10, available are a first transmission line 20*b*5 having the ground conductor 13 formed on one of the main faces and the line conductor 12 formed inside the dielectric substrate 11, and the second transmission line 30*b*5 having the line conductor 12 formed on one of the main faces of the dielectric substrate 11 and the ground conductor 13 formed on the other main-face, the second transmission line 30*b*5 being arranged in the concave portion of the first transmission line 20*b*5.

Figure 12:
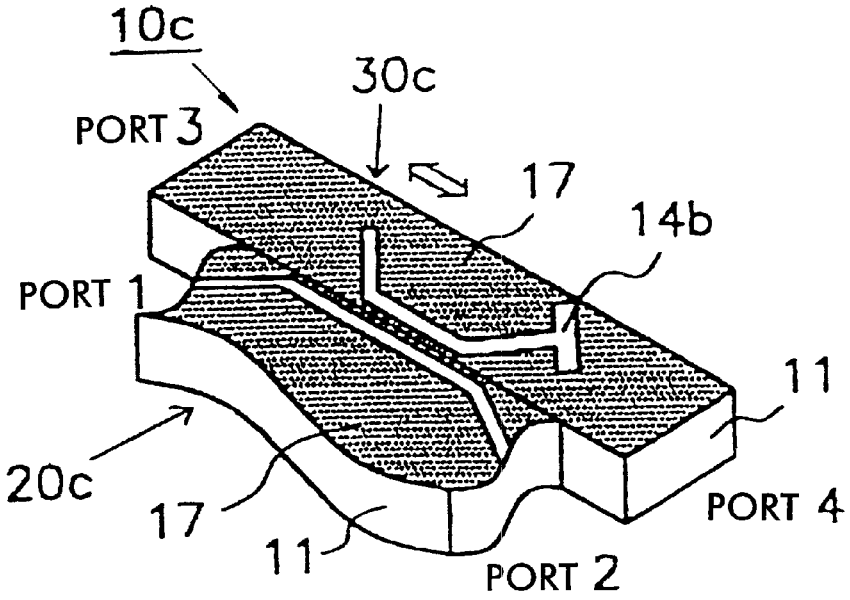
FIG. 12 is a perspective view of an antenna device according to a third embodiment of the present invention.

An antenna device including the directional coupler according to a third embodiment of the present invention will be now described with reference to FIG. 12. FIG. 12 is a perspective view of the antenna device of the instant embodiment. The basic function of the antenna device of the instant embodiment is the same as that of the antenna device of the first embodiment, and its detailed description will be omitted.

As shown in FIG. 12, the antenna device 10*c* of the instant embodiment comprises a directional coupler and a primary radiator. The directional coupler comprises a first transmission line 20*c* which comprises a slot line formed by two conductors 17 arranged on one of the main faces of the dielectric substrate 11 through a gap between them, and a second transmission line 30*c* which comprises a slot line formed in a similar manner. The primary radiator comprises a slot antenna 14*b* connected to the second transmission line 30*c*. The first transmission line 20*c* and the second transmission line 30*c* have their transmission line portions which are linearly adjacent to each other. Through the portions, the two transmission lines are coupled to each other and function as a directional coupler. The first transmission line 20*c* is fixed, and a driving mechanism (not shown in FIG. 12) using a voice coil motor, a pulse motor, or the like is attached to the second transmission line 30*c*, and thereby, the second transmission line 30*c* can be shifted in the direction parallel to the line passing through the port 3 and the port 4 in FIG. 12.

Figure 13:
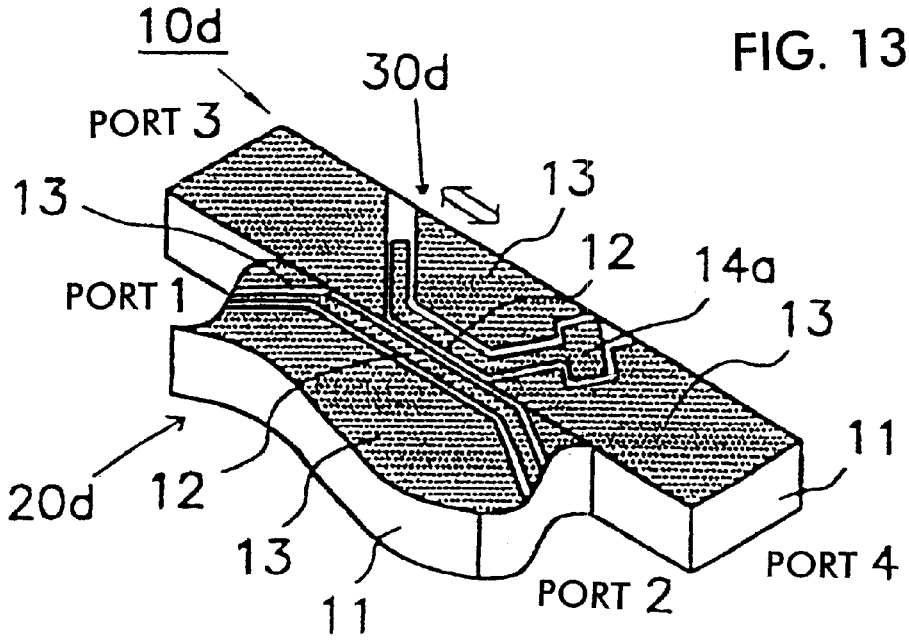
FIG. 13 is a perspective view of an antenna device according to a fourth embodiment of the present invention.

Further, an antenna device including the directional coupler according to a fourth embodiment of the present invention will be now described with reference to FIG. 13. FIG. 13 is a perspective view of the antenna device of the instant embodiment. The basic function of the antenna device of the instant embodiment is the same as that of the antenna device of the first embodiment, and its detailed description will be omitted.

As shown in FIG. 13, the antenna device 10*d* of the instant embodiment comprises a directional coupler and a primary radiator. The directional coupler comprises a first transmission line 20*d* which comprises a coplanar line comprises the line conductor 12 formed on one of the main-faces of the dielectric substrate 11 and the ground conductor 13 arranged through a space to the line conductor 12, and a second transmission line 30*d* which comprises a coplanar line formed in a similar manner. The primary radiator comprises a patch antenna 14*a* connected to the second transmission line 30*d*. The first transmission line 20*d* and the second transmission line 30*d* have their transmission line portions which are linearly adjacent to each other. Through the portions, the two transmission lines are coupled to each other and function as the directional coupler. The first transmission line 20*d* is fixed, and a driving mechanism (not shown in FIG. 13) using a voice coil motor, a pulse motor, or the like is attached to the second transmission line 30*d*, and thereby, the second transmission line 30*d* can be shifted in the direction parallel to the line passing through the port 3 and the port 4 in FIG. 13.

Figure 14:
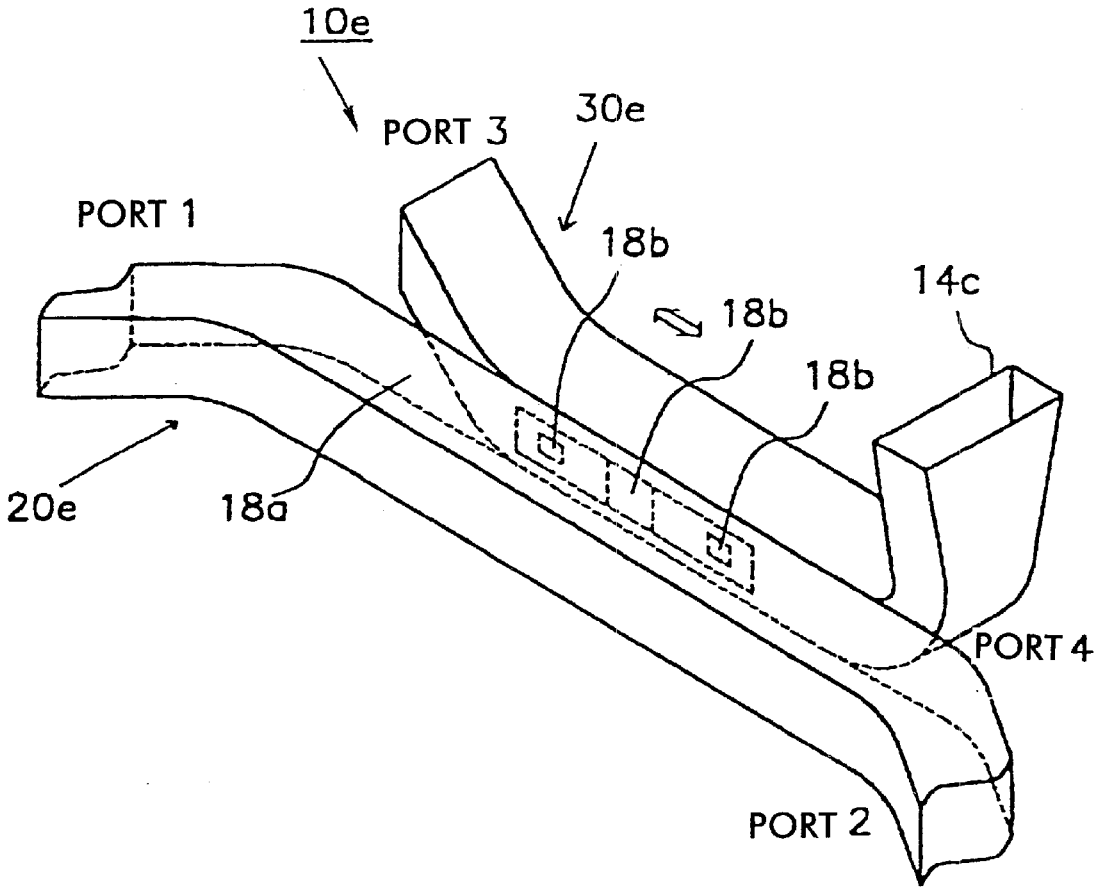
FIG. 14 is a perspective view of an antenna device according to a fifth embodiment of the present invention.

Further, an antenna device including the directional coupler according to a fifth embodiment of the present invention will be now described with reference to FIG. 14. FIG. 14 is a perspective view of the antenna device of the instant embodiment. The basic function of the antenna device of the instant embodiment is the same as that of the antenna device of the first embodiment, and its detailed description will be omitted.

As shown in FIG. 14, an antenna device 10*e* of the instant embodiment comprises a directional coupler and a primary radiator. The directional coupler comprises a first transmission line 20*e* which comprises a guide wave, and a second transmission line 30*e* which comprises a guide wave as well. The primary radiator comprises a horn antenna 14*c* connected to the second transmission line 30*e*. The first transmission line 20*e* is fixed, and a driving mechanism (not shown in FIG. 14) using a voice coil motor, a pulse motor, or the like is attached to the second transmission line 30*e*, and thereby, the second transmission line 30*e* can be shifted in the direction parallel to the line passing through the port 3 and the port 4 in FIG. 14. The first transmission line 20*e* and the second transmission line 30*e* have their transmission line portions which are linearly adjacent to each other. Through the portions, the two transmission lines are coupled to each other and function as a directional coupler. More particularly, at the surfaces of the first transmission line 20*e* and the second transmission line 30*e* which are adjacent to each other, holes 18*a* and 18*b* for coupling are formed, respectively. The hole 18*a* of the first transmission line 20*e* has a larger size in the shifting direction than each of the holes 18*b* of the second transmission line 30*e*. Accordingly, the first transmission line 20*e* and the second transmission line 30*e* keep with each other when the second transmission line 30*e* is shifted, due to the holes 18*a* and 18*b* for coupling, and the horn antenna 14*c* can be shifted. In the instant embodiment, the antenna device 10*e* having three holes 18*b* for coupling which are separated at a distance of $\lambda g/4$ from each other is used. However, at least four holes for coupling may be formed.

Figure 15:
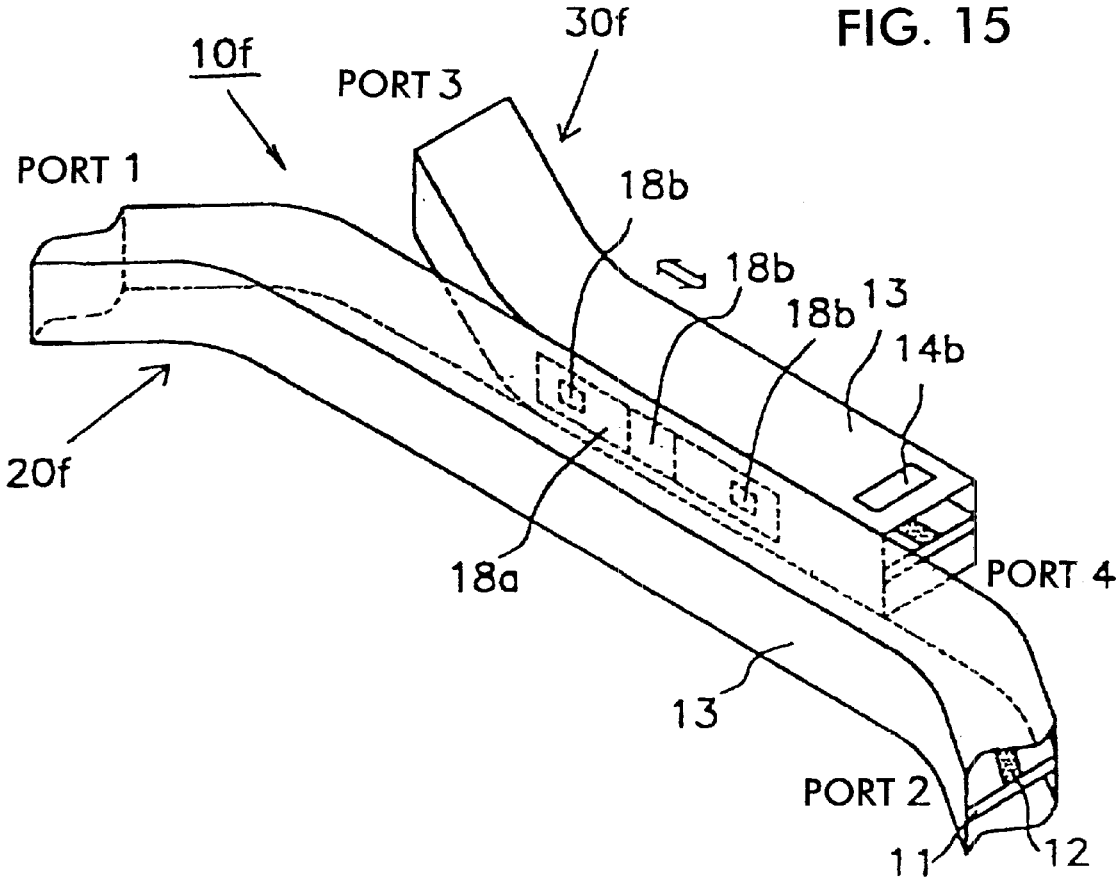
FIG. 15 is a perspective view of an antenna device according to a sixth embodiment of the present invention.

Further, an antenna device including the directional coupler according to a sixth embodiment of the present invention will be now described with reference to FIG. 15. FIG. 15 is a perspective view of the antenna device of the instant embodiment. The basic function of the antenna device of the instant embodiment is the same as that of the antenna device of the first embodiment, and its detailed description will be omitted.

As shown in FIG. 15, an antenna device 10*f* of the instant embodiment comprises coupler and a primary radiator. The directional coupler comprises a first transmission line 20*f* which comprises a suspended line comprises a cylindrical ground conductor 13, the dielectric substrate 11 disposed in the center of the ground conductor 13, and the line conductor 12 formed on the dielectric substrate 11, and a second transmission line 30*f* which comprises a suspended line formed in a similar manner. The primary radiator comprises a slot antenna 14*b* connected to the second transmission line 30*f*. The first transmission line 20*f* is fixed, and a driving mechanism (not shown in FIG. 15) using a voice coil motor, a pulse motor, or the like is attached to the second transmission line 30*f*, and thereby, the second transmission line 30*f* can be shifted in the direction parallel to the line passing through the port 3 and the port 4 in FIG. 15. The first transmission line 20*f* and the second transmission line 30*f* have their transmission line portions which are linearly adjacent to each other. Through the portions, the two transmission lines are coupled to each other and function as a directional coupler. More particularly, at the surfaces of the first transmission line 20*f* and the second transmission line 30*f* which are adjacent to each other, holes 18*a* and 18*b* for coupling are provided, respectively. The hole 18*a* of the first transmission line 20*f* has a larger size in the shifting direction than the hole 18*b* of the second transmission line 30*f*. Accordingly, the first transmission line 20*f* and the second transmission line 30*f* maintain coupling with each other when the second transmission line 30*f* is shifted, due to the holes 18*a* and 18*b* for coupling, and the slot antenna 14*b* can be shifted.

In the above-described embodiments, as the first transmission line and the second transmission line, lines of the sane type, for example, the microstrip line and the microstrip line, are employed. However, the directional coupler may be formed of a combination of transmission lines of different types, for example, a microstrip line and a coplanar line or the like may be employed.

Figure 16:
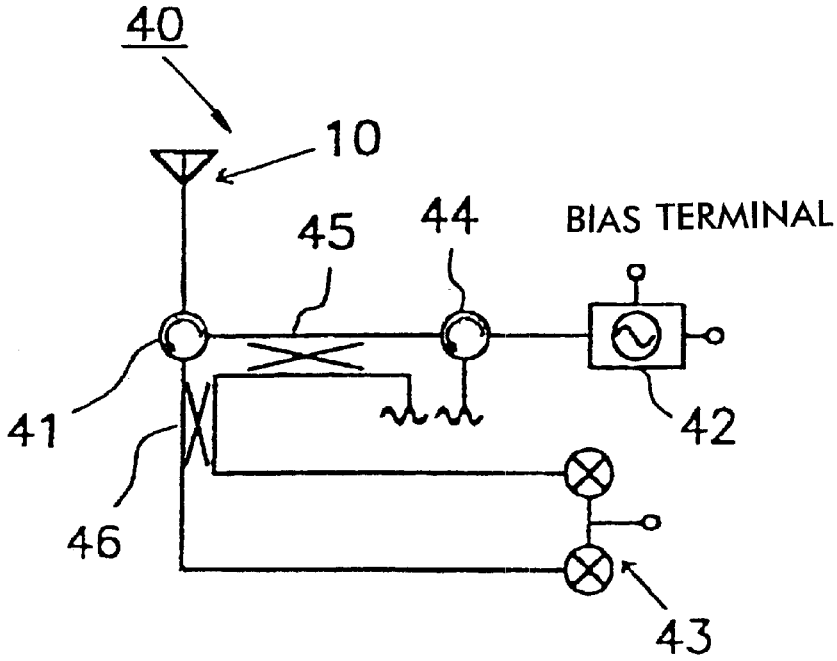
FIG. 16 is a block diagram showing the configuration of a transmitting-receiving device according to the present invention.

Hereinafter, a transmitting-receiving device in accordance with the present invention will be described with reference to FIG. 16. FIG. 16 is a block diagram showing the configuration of the transmitting-receiving device of the present invention.

As shown in FIG. 16, a transmitting-receiving device 40 of the present invention comprises an antenna 10, a circulator 41 connected to the antenna 10, an oscillator 42 connected to one of the ports of the circulator 41, a mixer 43 connected to the other port of the circulator 41, a second circulator 44 connected between the circulator 41 and the oscillator 42, and couplers 45 and 46. In this case, the oscillator 42 is a voltage-controlled oscillator. The oscillation frequency is changed by applying a voltage to its bias terminal. The antenna device 10 in FIG. 16 is the same as that shown in each of the first through sixth embodiments. A dielectric lens (not shown in FIG. 16) is arranged in the radiation direction of an electromagnetic wave from the primary antenna device. In the transmitting-receiving device 40 having the above-described configuration, a signal from the oscillator 42 is propagated through the circulator 44, the coupler 45, and the circulator 41 to the primary radiator of the antenna device 10, and radiated through the dielectric lens. A part of the signal from the oscillator 42 as a local signal is supplied through the couplers 45 and 46 to the mixer 43. The reflected wave from an object is supplied through the antenna device 10, the circulator 41, and the coupler 46 to the mixer 43 as an RF signal. The mixer 43 as a balanced mixer outputs as an IF signal a differential component between the RF signal and the local signal.

Hereinafter, exemplified applications of the directional coupler in accordance with the present invention will be described with reference to FIGS. 17 through 24. The embodiment described below can be applied to all the above described transmission lines. However, the description will be carried out in reference to the microstrip lines. Like parts of the first embodiment and the instant embodiment are designated by like reference numerals and signs, and their detailed description will be omitted.

An example of the antenna device with which the scanning with radiation beams can be performed in three sections, namely, in upper, middle, and lower sections will be now described with reference to FIGS. 17 through 20. FIGS. 17 through 20 are plan views of the antenna device of the instant embodiment, respectively.

Figure 17:
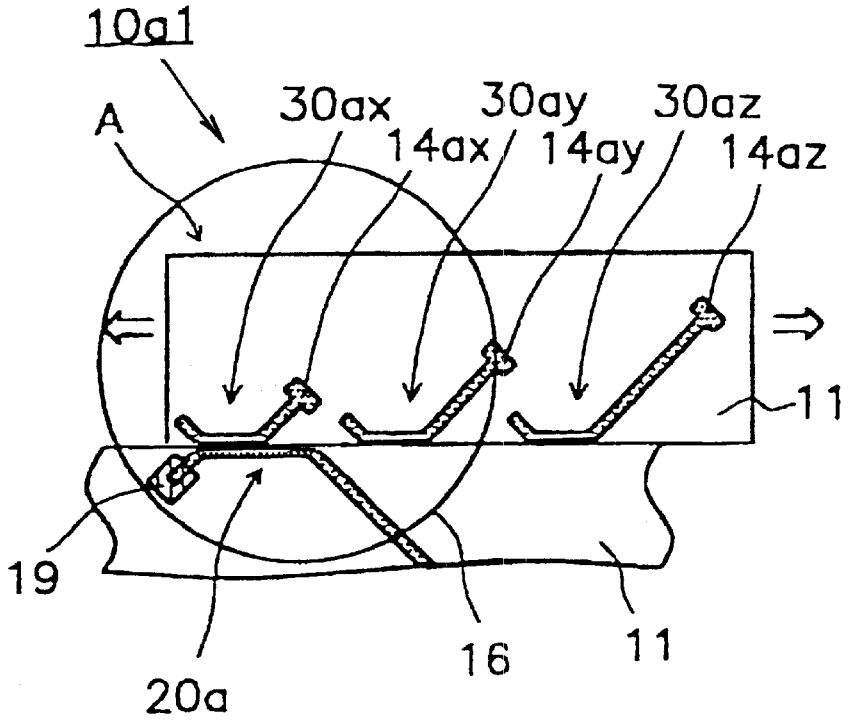
FIG. 17 is a plan view of an antenna device as an exemplified application of a directional coupler of the present invention.

As shown in FIG. 17, an antenna device 10*a*1 of the instant embodiment comprises a fixed first transmission line 20*a*, a shifting section A including three second transmission lines 30*ax*, 30*ay*, and 30*az* and three patch antennas 14*ax*, 14*ay*, and 14*az* connected to the second transmission lines 30*ax*, 30*ay*, and 30*az*, respectively, and a dielectric lens 16 fixed to the upper side of them. Further, a terminal resistive film 19 is formed on one end of the first transmission line 20*a*.

In the antenna device 10*a*1 having the above-described configuration, for example, as shown in FIG. 17, when the first transmission line 20*a* and the second transmission line 30*ax* have their portions linearly adjacent to each other, both are coupled to each other, and an electromagnetic wave is radiated through the patch antenna 14*ax*. The shifting section A is shifted while the first transmission line 20*a* and the second transmission line 30*ax* are kept in the coupled state, and thereby, the position of the patch antenna 14*ax* is changed, so that the scanning of the radiation beam can be performed in the lower section.

Figure 18:
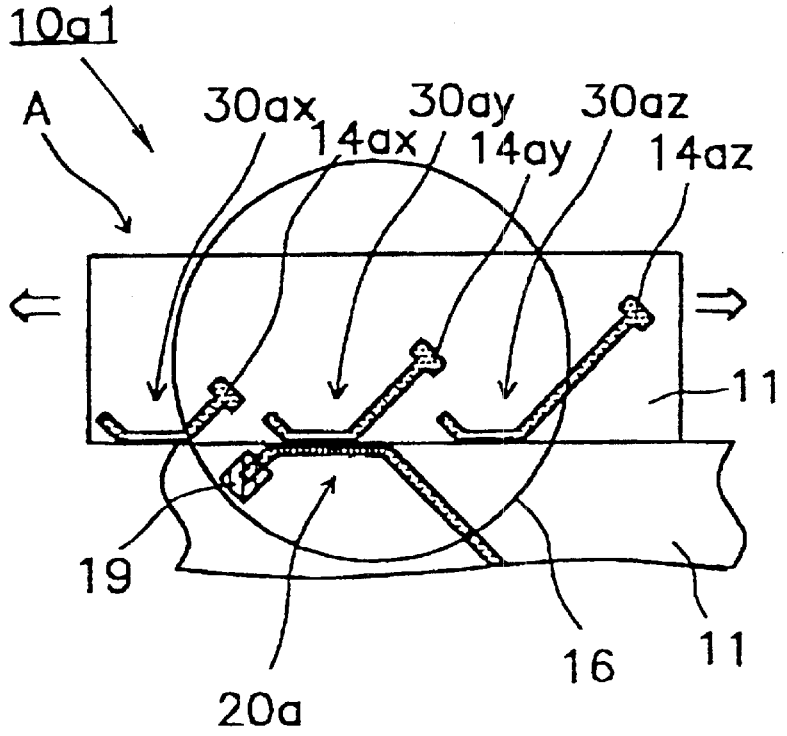
FIG. 18 is a plan view of an antenna device as an exemplified application of a directional coupler of the present invention.

The shifting section A is further shifted, so that the first transmission line 20*a* and the second transmission line 30*ay* move so as to have their portions linearly adjacent to each other, as shown in FIG. 18, when both are coupled to each other, and an electromagnetic wave is radiated through the patch antenna 14*ay*. That is, the shifting section A is shifted while the coupling state is maintained, and thereby, the position of the patch antenna 14*ay* is shifted, so that the scanning with the radiation beam can be carried out in the middle section.

Figure 19:
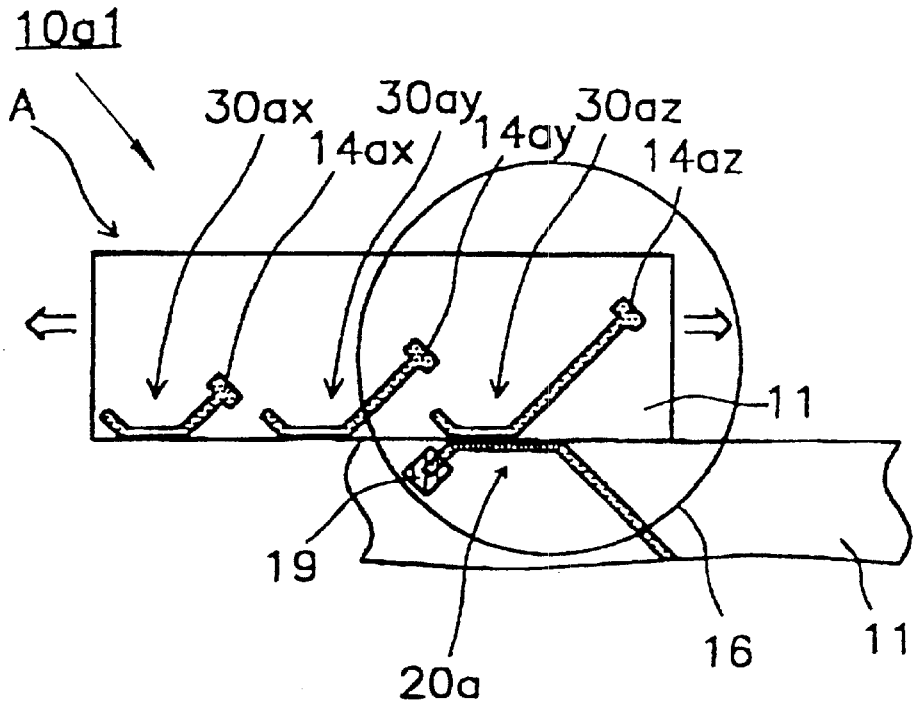
FIG. 19 is a plan view of an antenna device as an exemplified application of a directional coupler of the present invention.

Similarly, as shown in FIG. 19, when the first transmission line 20*a* and the second transmission line 30*az* move so as to have the linearly-adjacent portions, both are coupled to each other, and an electromagnetic wave is radiated through the patch antenna 14*az*. Thus, while the coupling state is maintained, the shifting section A is shifted, and thereby, the position of the patch antenna 14*az* is shifted so that the scanning with the radiation beam in the upper section can be performed.

Figure 20:
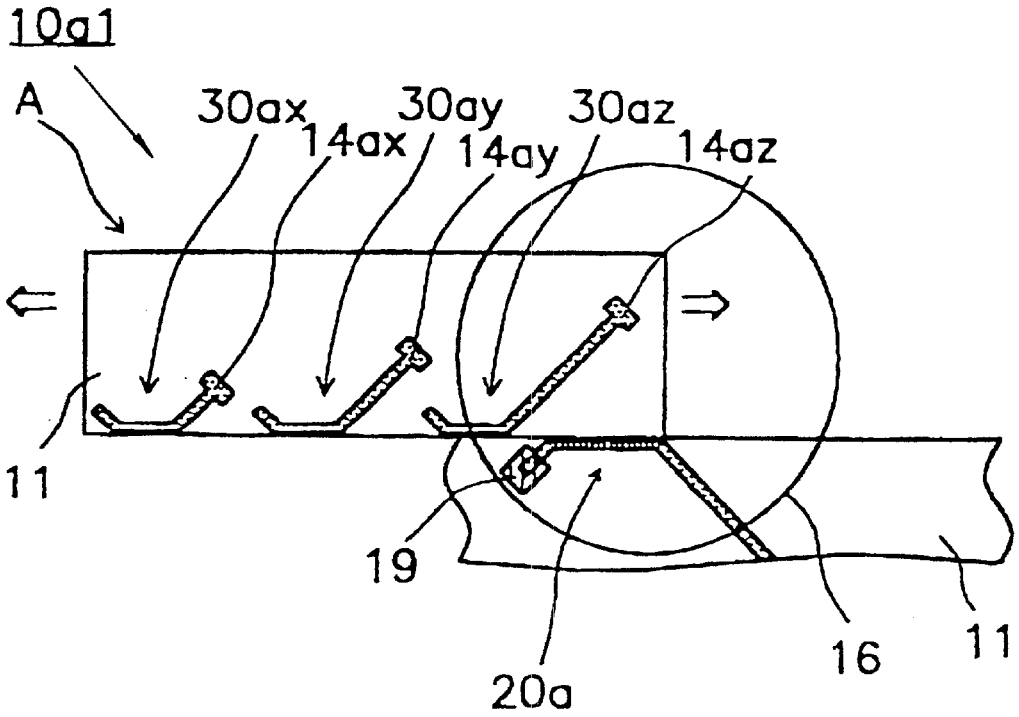
FIG. 20 is a plan view of an antenna device as an exemplified application of a directional coupler of the present invention.

Further, when the shifting section A is shifted to the position shown in FIG. 20, the first transmission line 20*a* is not coupled to any of the second transmission lines, and no beam is radiated through the antenna device 10*a*1.

In the above example, a method for switching the three primary radiators is described. In addition to the method, other functions can be rendered by the directional coupler. More particularly, for example, in the directional coupler having one first transmission line and one second transmission line, the second transmission line is shifted, and thereby, the coupling state in which the first and second transmission lines have the linearly-adjacent portions is changed to the non-coupling state where the linearly-adjacent portions are absent. Thus, a signal sent from the first transmission line can be switched to "be transmitted" or "not to be transmitted" to the second transmission line. Accordingly, the directional coupler can be used as a switch.

Figure 21:
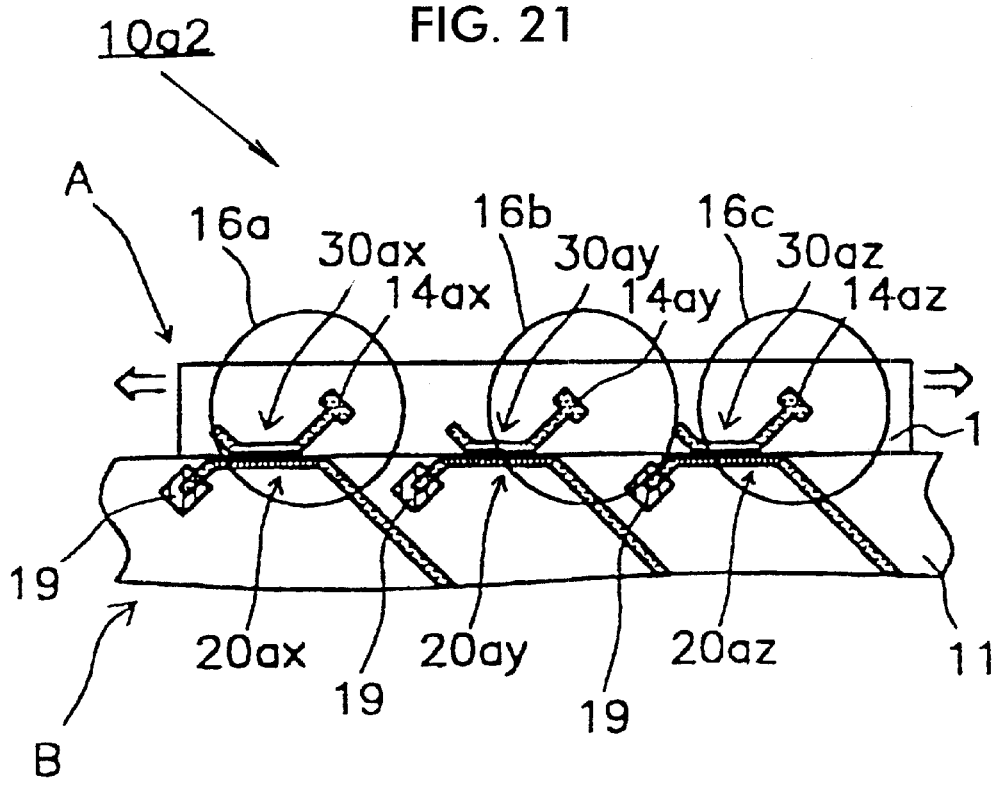
FIG. 21 is a plan view of an antenna device as a further exemplified application of a directional coupler of the present invention.
Figure 22:
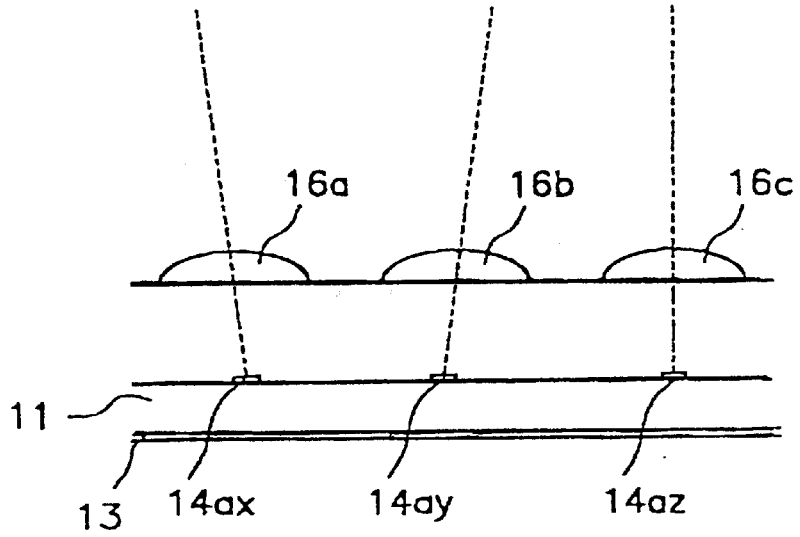
FIG. 22 is a side view of a primary radiator and a dielectric lens antenna showing the concept of a method of beam scanning.
Figure 23:
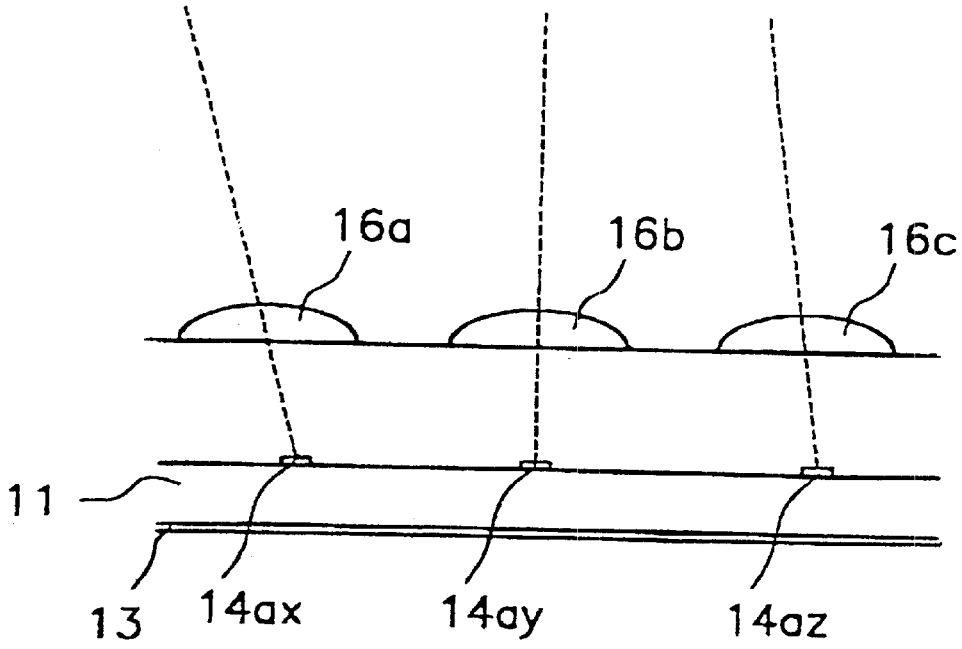
FIG. 23 is a side view of a primary radiator and a dielectric lens antenna showing the concept of a method of beam scanning.
Figure 24:
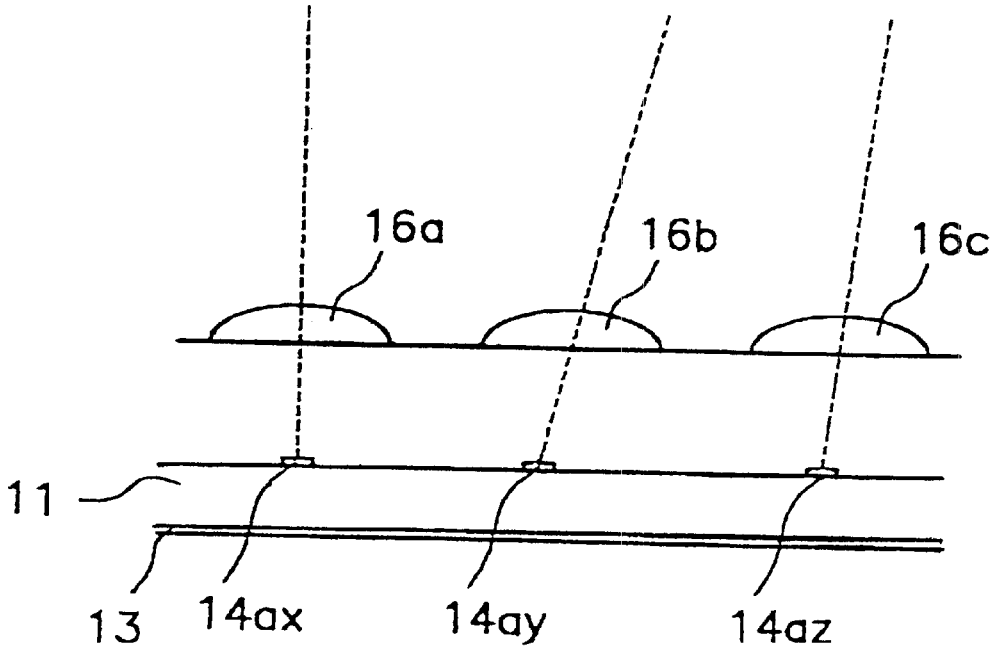
FIG. 24 is a side view of a primary radiator and a dielectric lens antenna showing the concept of a method of beam scanning.
Figure 25:
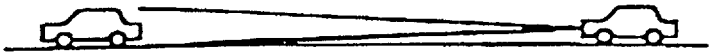
FIG. 25 is a block diagram showing the use situation of a radar for car-mounting.
Figure 26:
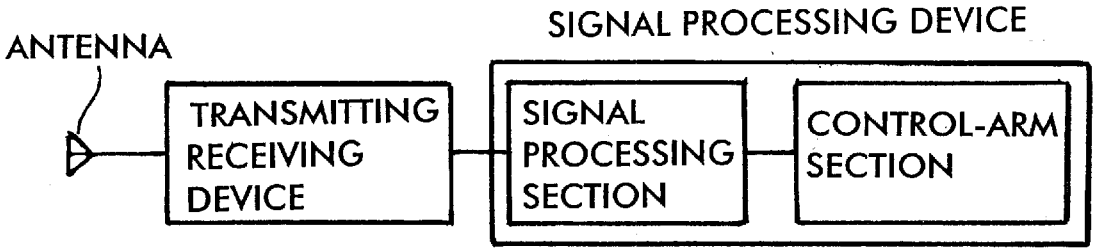
FIG. 26 is a block diagram showing the configuration of the radar for car-mounting.
Figure 27:
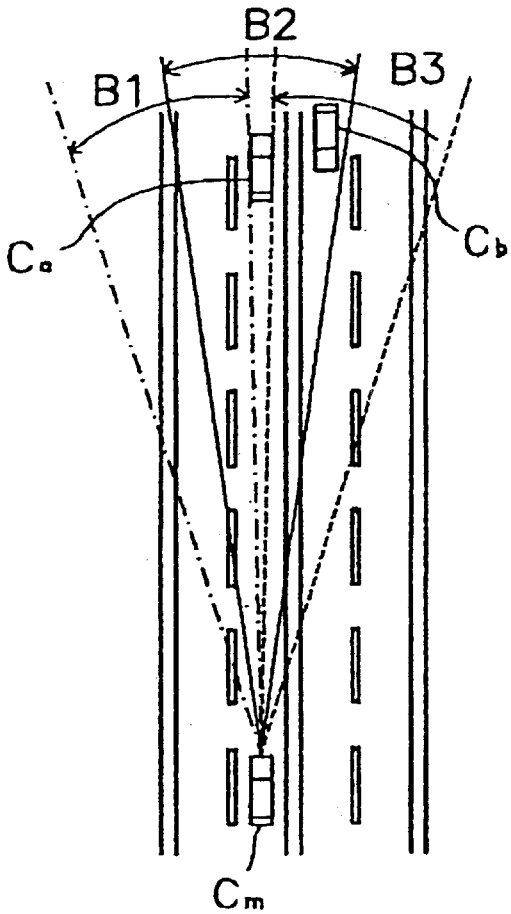
FIG. 27 is an illustration of the situation that in the radar for car-mounting, the radiation beam is tilted in the horizontal direction.
Figure 28:
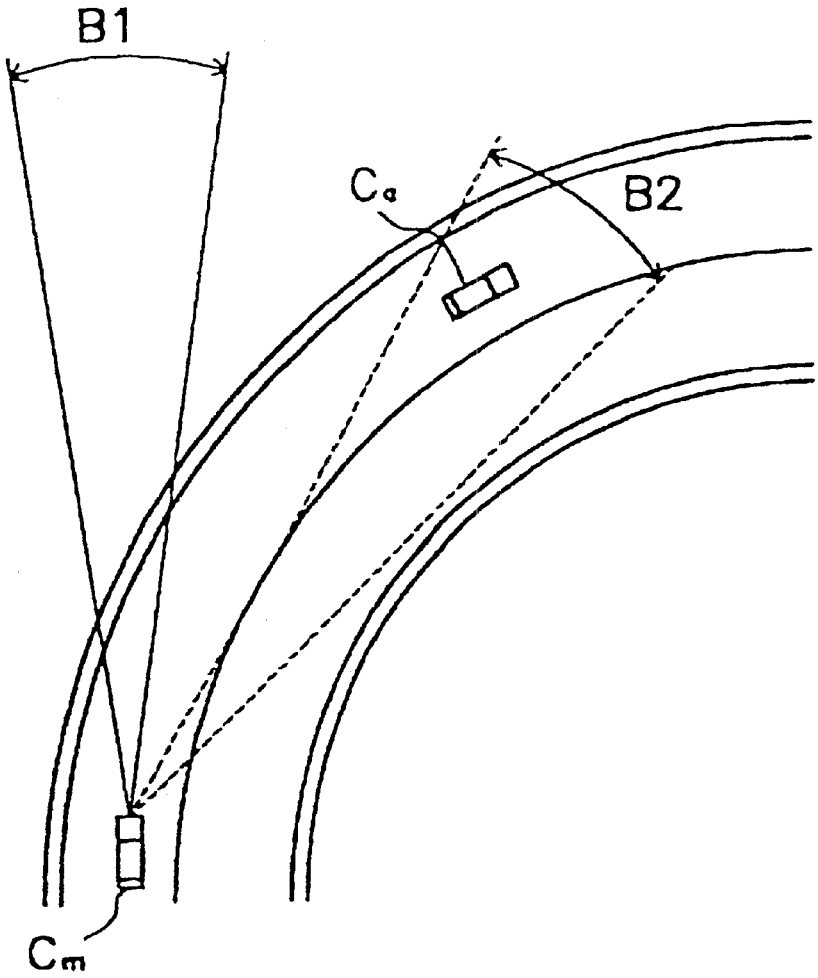
FIG. 28 is an illustration of the situation that the radiation beam in the radar for car-mounting is tilted in the horizontal direction.
Figure 29:
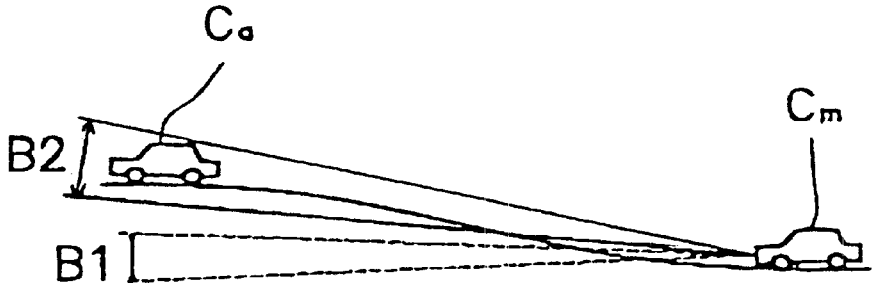
FIG. 29 is an illustration of the situation that the radiation beam in the radar for car-mounting is tilted in the vertical direction.

Hereinafter, an example of the antenna device with which the scanning can be performed with plural radiation beams at the same time will be described with reference to FIGS. 21 through 24. FIG. 21 is a plan view of the antenna device of the instant embodiment. FIGS. 22 through 24 are side views showing the concept of the beam scanning, respectively.

As shown in FIG. 21, an antenna device 10*a*2 of the instant embodiment comprises a fixed section B having three first transmission lines 20*ax*, 20*ay*, and 20*az*, a shifting section A having the three second transmission lines 30*ax*, 30*ay*, and 30*az* to be coupled to the first transmission lines 20*ax*, 20*ay*, and 20*az*, the three patch antennas 14*ax*, 14*ay*, and 14*az* connected to the second transmission lines 30*ax*, 30*ay*, and 30*az*, respectively, and three dielectric lenses 16*a*, 16*b*, and 16*c* fixed to the upper side of them. An electromagnetic wave is sent through the patch antenna 14*ax*, which is one of the three patch antennas 14*ax*, 14*ay*, and 14*az*, and an electromagnetic wave is received through the other two patch antennas 14*ax* and 14*ay*. To the three first transmission lines 20*ax*, 20*ay*, and 20*az*, an appropriate transmitting or receiving circuit, not shown in FIG. 21, is connected, and thereby, a transmitting-receiving device is formed. Terminal resistive films 19 are formed on one ends of the first transmission lines 20*ax*, 20*ay*, and 20*az*, respectively.

In the antenna device 10*a*2 having the above structure, the shifting section A is shifted by use of a driving means not shown in FIG. 21, and thereby, the three patch antennas 14*ax*, 14*ay*, and 14*az* are simultaneously shifted. By use of the antenna device 10*a*2 having the above function, an angle can be measured in a wide range at a desired detection distance with an appropriate measuring-angle resolution power.

More particularly, as shown in FIG. 22, at a point in time, the positions of the patch antennas 14*ax*, 14*ay*, and 14*az*, and the dielectric lenses 16*a*, 16*b*, and 16*c* are so defined that a wave-sending beam is directed at 0° to the forward direction, one of the receiving beams to the right by 15° to the forward direction, and the other receiving beam to the left by 15° to the forward direction. In this case, the angle measurement can be carried out in the range between the two receiving beams. If the angle-measuring range is desired to be widened, provided that the defined positions of the patch antennas are fixed, a method for widening the ranges of the respective beams themselves and a method for widening the distance between the two beams may be provided. However, there is the problem that by the former method, the detection distance becomes short, while by the later method, the angle-measurement resolution power is reduced.

As seen in the instant embodiment, the shifting section A in which the three patch antennas 14*ax*, 14*ay*, and 14*az* are formed is shifted, so that for example, as shown in FIG. 23, the wave-sending beam is directed to the left by 15° to the forward direction, one of the receiving beams at 0° to the forward direction, and the other receiving beam to the left by 30° to the forward direction. Further, as shown in FIG. 24, the shifting section A is shifted in the opposite direction, so that the wave-sending beam is directed to the right by 15° to the forward direction, one of the receiving beam to the right by 30° to the forward direction, and the other receiving beam at 0° to the forward direction. In the above manner, the shifting section A is so shifted that the beam scans, and thereby, the angle-measurement can be performed in a wide range without the detection distance shortened or the angle-measurement resolution power reduced.

As described above, in the directional coupler including the two transmission lines, the relative position of the two transmission lines is changed while the coupling is maintained. Accordingly, when the primary radiator is connected to one of the transmission lines, the position of the primary radiator can be shifted while the electromagnetic wave is being radiated. That is, by shifting the transmission line which is relatively light in weight, the radiation beam from the antenna can be caused to scan. Thus, it is unnecessary to provide a large-sized driving means for moving the whole of the casing containing the transmitting-receiving device, and the antenna device can be miniaturized.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A directional coupler comprising a first microstrip line and a second microstrip line adjacent to the first microstrip line, each line having a longitudinal extent extending substantially parallel to each other, the relative positions of said first microstrip line and said second microstrip line being changeable in a direction extending along the longitudinal extent, one of said lines having a smaller longitudinal extent than the other of said lines whereby a substantially uniform coupling can be achieved despite relative movement of said lines when the line having the smaller extent is bounded by the line having the longer extent.

2. The directional coupler of claim 1, further comprising an antenna element coupled to one of said microstrip lines.

3. A directional coupler comprising a first strip line and a second strip line adjacent to the first strip line, the relative positions of said first strip line and said second strip line being changeable.

4. The directional coupler of claim 3, further comprising an antenna element coupled to one of said strip lines.

5. A directional coupler comprising a first slot line and a second slot line adjacent to the first slot line, each line having a longitudinal extent extending substantially parallel to each other, the relative positions of said first slot line and said second slot line being changeable in a direction extending along the longitudinal extent, one of said lines having a smaller longitudinal extent than the other of said lines whereby a substantially uniform coupling can be achieved despite relative movement of said lines when the line having the smaller extent is bounded by the line having the longer extent.

6. The directional coupler of claim 5, further comprising an antenna element coupled to one of said slot lines.

7. A directional coupler comprising a first coplanar line and a second coplanar line adjacent to the first coplanar line, each line having a longitudinal extent extending substantially parallel to each other, the relative positions of said first coplanar line and said second coplanar line being changeable in a direction extending along the longitudinal extent, one of said line having a smaller longitudinal extent than the other of said lines whereby a substantially uniform coupling can be achieved despite relative movement of said lines when the line having the smaller extent is bounded by the line having the longer extent.

8. The directional coupler of claim 7, further comprising an antenna element coupled to one of said coplanar lines.

9. A directional coupler comprising a first waveguide and a second waveguide adjacent to the first waveguide, each waveguide having a longitudinal extent extending substantially parallel to each other, the relative positions of said first waveguide and said second waveguide being changeable in a direction extending along the longitudinal extent, one of said waveguides having a smaller longitudinal extent than the other of said waveguides whereby a substantially uniform coupling an be achieved despite relative movement of said waveguides when the waveguide having the smaller extent is bounded by the waveguide having the longer extent.

10. The directional coupler of claim 9, further comprising an antenna element coupled to one of said waveguides.

11. The directional coupler of claim 9, wherein at least one slot is provided in each wave guide for changing a degree of coupling.

12. A directional coupler comprising a first suspended line and a second suspended line adjacent to the first suspended line, each line having a longitudinal extent extending substantially parallel to each other, the relative positions of said first suspended line and said second suspended line being changeable in a direction extending along the longitudinal extent, one of said lines having a smaller longitudinal extent than the other of said lines whereby a substantially uniform coupling can be achieved despite relative movement of said lines when the line having the smaller extent is bounded by the line having the longer extent.

13. The directional coupler of claim 12, further comprising an antenna element coupled to one of said suspended lines.

14. The directional coupler of claim 12, wherein at least one slot is provided coupled with each suspended line for changing a degree of coupling.

15. An antenna device including a directional coupler comprising a first microstrip line and a second microstrip line adjacent to the first microstrip line, each line having a longitudinal extent extending substantially parallel to each other, the relative positions of said first microstrip line and said second microstrip line being changeable in a direction extending along the longitudinal extent, one of said lines having a smaller longitudinal extent that the other of said lines whereby a substantially uniform coupling can be achieved despite relative movement of said lines when the line having the smaller extent is bounded by the line having the longer extent, a primary radiator coupled or connected to a part of the directional coupler, and a driving mechanism for driving the directional coupler and the primary radiator.

16. An antenna device including a directional coupler comprising a first strip line and a second strip line adjacent to the first strip line, each line having a longitudinal extent extending substantially parallel to each other, the relative positions of said first strip line and said second strip line being changeable in a direction extending along the longitudinal extent, one of said lines having a smaller longitudinal extent than the other of said lines whereby a substantially uniform coupling can be achieved despite relative movement of said lines when the line having the smaller extent is bounded by the line having the longer extent, a primary radiator coupled or connected to a part of the directional coupler, and a driving mechanism for driving the directional coupler and the primary radiator.

17. An antenna device including a directional coupler comprising a first slot line and a second slot line adjacent to the first slot line, each line having a longitudinal extent extending substantially parallel to each other, the relative positions of said first slot line and said second slot line being changeable in a direction extending along the longitudinal extent, one of said lines having a smaller longitudinal extent than the other of said lines whereby a substantially uniform coupling can be achieved despite relative movement of said lines when the line having the smaller extent is bounded by the line having the longer extent, a primary radiator coupled or connected to a part of the directional coupler, and a driving mechanism for driving the directional coupler and the primary radiator.

18. An antenna device including a directional coupler comprising a first coplanar line and a second coplanar line adjacent to the first coplanar line, each line having a longitudinal extent extending substantially parallel to each other, the relative positions of said first coplanar line and said second coplanar line being changeable in a direction extending along the longitudinal extent, one of said lines having a smaller longitudinal extent than the other of said lines whereby a substantially uniform coupling can be achieved despite relative movement of said lines when the line having the smaller extent is bounded by the line having the longer extent, a primary radiator coupled or connected to a part of the directional coupler, and a driving mechanism for driving the directional coupler and the primary radiator.

19. An antenna device including a directional coupler comprising a first waveguide and a second waveguide adjacent to the first waveguide, each waveguide having a longitudinal extent extending substantially parallel to each other, the relative positions of said first waveguide and said second waveguide being changeable in a direction extending along the longitudinal extent, one of said waveguides having a smaller longitudinal extent than the other of said waveguides whereby a substantially uniform coupling can be achieved despite relative movement of said waveguides when the waveguide having the smaller extent is bounded by the waveguide having the longer extent, a primary radiator coupled or connected to a part of the directional coupler, and a driving mechanism for driving the directional coupler and the primary radiator.

20. An antenna device including a directional coupler comprising a first suspended line and a second suspended line adjacent to the first suspended line, each line having a longitudinal extent extending substantially parallel to each other, the relative positions of said first suspended line and said second suspended line being changeable in a direction extending along the longitudinal extent, one of said lines having a smaller longitudinal extent than the other of said lines whereby a substantially uniform coupling an be achieved despite relative movement of said lines when the line having the smaller extent is bounded by the line having the longer extent, a primary radiator coupled or connected to a part of the directional coupler, and a driving mechanism for driving the directional coupler and the primary radiator.

21. A transmitting-receiving device including an antenna device comprising a directional coupler comprising a first microstrip line and a second microstrip line adjacent to the first microstrip line, each line having a longitudinal extent extending substantially parallel to each other, the relative positions of said first microstrip line and said second microstrip line being changeable in a direction extending along the longitudinal extent, one of said lines having a smaller longitudinal extent than the other of said lines whereby a substantially uniform coupling can be achieved despite relative movement of said lines when the line having the smaller extent is bounded by the line having the longer extent, a primary radiator coupled or connected to a part of the directional coupler, and a driving mechanism for driving the directional coupler and the primary radiator, and a transmitting-receiving circuit connected to the antenna device.

22. A transmitting-receiving device including an antenna device comprising a directional coupler comprising a first strip line and a second strip line adjacent to the first strip line, each line having a longitudinal extent extending substantially parallel to each other, the relative positions of said first strip line and said second strip line being changeable in a direction extending along the longitudinal extent, one of said lines having a smaller longitudinal extent than the other of said lines whereby a substantially uniform coupling can be achieved despite relative movement of said lines when the line having the smaller extent is bounded by the line having the longer extent, a primary radiator coupled or connected to a part of the directional coupler, and a driving mechanism for driving the directional coupler and the primary radiator, and a transmitting-receiving circuit connected to the antenna device.

23. A transmitting-receiving device including an antenna device comprising a directional coupler comprising a first slot line and a second slot line adjacent to the first slot line, each line having a longitudinal extent extending substantially parallel to each other, the relative positions of said first slot line and said second slot line being changeable in a direction extending along the longitudinal extent, one of said lines having a smaller longitudinal extent than the other of said lines whereby a substantially uniform coupling can be achieved despite relative movement of said lines when the line having the smaller extent is bounded by the line having the longer extent, a primary radiator coupled or connected to a part of the directional coupler, and a driving mechanism for driving the directional coupler and the primary radiator, and a transmitting-receiving circuit connected to the antenna device.

24. A transmitting-receiving device including an antenna device comprising a directional coupler comprising a first coplanar line and a second coplanar line adjacent to the first coplanar line, each line having a longitudinal extent extending substantially parallel to each other, the relative positions of said first coplanar line and said second coplanar line being changeable in a direction extending along the longitudinal extent, one of said lines having a smaller longitudinal extent than the other of said lines whereby a substantially uniform coupling can be achieved despite relative movement of said lines when the line having the smaller extent is bounded by the line having the longer extent, a primary radiator coupled or connected to a part of the directional coupler, and a driving mechanism for driving the directional coupler and the primary radiator, and a transmitting-receiving circuit connected to the antenna device.

25. A transmitting-receiving device including an antenna device comprising a directional coupler comprising a first waveguide and a second waveguide adjacent to the first waveguide, each waveguide having a longitudinal extent extending substantially parallel to each other, the relative positions of said first waveguide and said second waveguide being changeable in a direction extending along the longitudinal extent, one of said waveguides having a smaller longitudinal extent than the other of said waveguides whereby a substantially uniform coupling can be achieved despite relative movement of said waveguides when the waveguide having the smaller extent is bounded by the waveguide having the longer extent, a primary radiator coupled or connected to a part of the directional coupler, and a driving mechanism for driving the directional coupler and the primary radiator, and a transmitting-receiving circuit connected to the antenna device.

26. A transmitting-receiving device including an antenna device comprising a directional coupler comprising a first suspended line and a second suspended line adjacent to the first suspended line, each line having a longitudinal extent extending substantially parallel to each other, the relative positions of said first suspended line and said second suspended line being changeable in a direction extending along the longitudinal extent, one of said lines having a smaller longitudinal extent than the other of said lines whereby a substantially uniform coupling can be achieved despite relative movement of said lines when the line having the smaller extent is bounded by the line having the longer extent, a primary radiator coupled or connected to a part of the directional coupler, and a driving mechanism for driving the directional coupler and the primary radiator, and a transmitting-receiving circuit connected to the antenna device.

* * * * *